US006470877B1

(12) United States Patent
Waters

(10) Patent No.: US 6,470,877 B1
(45) Date of Patent: Oct. 29, 2002

(54) HEATING APPARATUS

(75) Inventor: Michael Waters, Barrington Hills, IL (US)

(73) Assignee: Blue Rhino Corporation, Winston-Salem, NC (US)

( * ) Notice: Subject to any disclaimer, the term of this patent is extended or adjusted under 35 U.S.C. 154(b) by 0 days.

(21) Appl. No.: 09/640,199

(22) Filed: Aug. 16, 2000

Related U.S. Application Data

(63) Continuation of application No. 09/531,845, filed on Mar. 20, 2000, which is a division of application No. 09/289,251, filed on Apr. 9, 1999, now Pat. No. 6,102,031, which is a continuation-in-part of application No. 09/156,944, filed on Sep. 18, 1998, now abandoned.

(51) Int. Cl.[7] ..... F24C 15/22; F24C 3/04

(52) U.S. Cl. ..... 126/92 AC; 126/92 B

(58) Field of Search ..... 126/92 R, 92 AC, 126/92 B

(56) References Cited

FOREIGN PATENT DOCUMENTS

| | | | | |
|---|---|---|---|---|
| IT | 526841 | * | 5/1955 | ..... 126/92 B |
| JP | 7-286736 | * | 10/1995 | |
| JP | 9-196381 | * | 7/1997 | |

* cited by examiner

*Primary Examiner*—Sara Clarke
(74) *Attorney, Agent, or Firm*—Greer, Burns & Crain, Ltd.

(57) ABSTRACT

A heating apparatus is provided which is improved in terms of its heating efficiencies over prior commercially available patio heaters. The heating apparatus includes a burner assembly housing containing a burner assembly for igniting fuel from a fuel source. The housing has a perforated wall so that the hot gases inside the housing can escape from the housing interior with the wall heating up so as to radiate infrared heat therefrom. The apparatus has a heat efficiency system which causes substantially all of the heat emanating from the housing to be used for heating of a preselected area about the apparatus. The heat efficiency system maximizes the amount of heat that is directed in a generally downward direction into the preselected area below the housing so as to minimize the heat loss and thus the amount of fuel that is necessary for heating of the preselected area.

10 Claims, 8 Drawing Sheets

HEATING APPARATUS

This is a continuation, of prior application Ser. No. 09/531,845, filed Mar. 20, 2000, which is a division of prior application Ser. No. 09/289,251, filed Apr. 9, 1999, now U.S. Pat. No. 6,102,031, which is a continuation-in-part of prior application Ser. No. 09/156,944 filed Sep. 18, 1998, abandoned, which is hereby incorporated herein by reference in its entirety.

FIELD OF THE INVENTION

The invention relates to a heating apparatus and, more particularly, to a high efficiency heating apparatus for warming a preselected area.

BACKGROUND OF THE INVENTION

LP/propane or natural gas fueled heaters such as patio heaters are available in both free-standing and built-in configurations, and are primarily sold for commercial applications. For example, patio heaters have become especially popular in recent years in areas such as the Southwest where no smoking laws are being applied to taverns and bars forcing patrons outdoors to smoke which can be especially inconvenient during cold nights. Patio heaters can be utilized to provide warmth in preselected outdoor areas making it much more comfortable for smokers, and for those who like to be outdoors.

Free-standing patio heaters that can be readily moved from location to location to heat preselected areas typically have a base that is sized to contain a fuel tank therein and an elongate hollow support standard projecting upward therefrom to a burner assembly housing in which air is heated by combustion of the fuel gases from the tank in the base. The burner assembly housing has a cylindrical wall provided with apertures to provide for the escape of the hot products of combustion in the housing. The flow of hot gases through the wall apertures heats the wall so that the wall emits radiant infra-red heat. A relatively large dome-shaped reflector hood is attached on top of the housing and opens downwardly for reflecting heat emanating from the housing generally downwardly about the standard of the patio heater. In the built-in configuration which typically will not be moved after the unit is installed, the heater is connected to a source of gas such as provided by a gas utility company thus eliminating the need for the base so that the standard extends all the way from the ground up to the burner assembly housing. In each of the free-standing and built-in configurations, the burner assembly housing and reflector dome have substantially the same construction.

One shortcoming of presently available patio heaters is in their heating efficiency. The apertured cylindrical wall has portions exposed below the bottom of the dome reflector hood such that heat emitted therefrom may not encounter the dome, and instead of being directed downwardly thereby for heating of the area around the standard, the heat travels in a generally unimpeded path radially away from the heater so as to provide little or no heating effect to the area below which is desired to be warmed. Further, once the patio heater is turned on, the area heated is the entire 360° circumference around the unit; however, this entire area may not need to be heated such as where the heater is adjacent a corner of the patio so that it is difficult for people to stand around the entire 360° area under the hood.

A further deficiency lies in the large size of the metal reflector domes, typically on the order of 34½ inches in diameter. The large dome is expensive and difficult to store and ship in a compact manner. Current packaging of the apparatus is likewise rendered more difficult where the apparatus has a large size dome reflector which restricts the ability to properly display and shelve the apparatus for retail sale.

Accordingly, there is a need for a heating apparatus such as a patio heater which better maximizes its heating efficiency. A further need exists for a heating apparatus that can be stored and shipped in a compact and cost-efficient manner. In addition, a patio heater that can be compactly packaged would be desirable for retail sale.

SUMMARY OF THE INVENTION

In accordance with the present invention, a heating apparatus is provided which is improved in terms of its heating efficiencies over prior commercially available patio heaters. The present heating apparatus is for igniting fuel from a fuel tank having valve controls that control supply of fuel from the tank. The heating apparatus includes a heat emitter including a burner assembly for igniting fuel from the fuel source to provide heat emanating from the emitter, an elongate support member mounting the heat emitter at an upper end thereof and including a gas line extending therethrough for feeding fuel from the tank to the burner assembly for ignition and a shroud for fitting over the fuel tank and including an access opening at a predetermined location on the shroud with the opening being sized to allow an operator access to the fuel tank control for controlling supply of fuel to the burner assembly.

In one form of the present invention, a heating apparatus aligned along a longitudinal axis is provided and includes a burner assembly for igniting fuel from a fuel source, and a housing for the burner assembly. An emitter surface of the housing includes apertures for directing heat generated by the ignited fuel out away from the housing. The emitter surface is inclined relative to the longitudinal axis so as to direct heat in a generally downward direction about the longitudinal axis for maximum efficiency in warming of a preselected area by the heat emitted from the housing. Angling of the emitter surface so that it is inclined relative to the vertical longitudinal axis of the heating apparatus substantially obviates the need for the large reflector dome as used with prior commercially available patio heaters as heat is directed out away from the burner assembly housing in a generally downward direction for heating of the preselected outdoor area. Further, because the emitter surface directs heat in the downward direction due to its inclination to the vertical, radiant heat directed straight out radially as with cylindrical apertured emitter surfaces is avoided thereby minimizing the amount of heat lost and increasing the efficiency of the apparatus in terms of the amount of fuel necessary to keep a given area defined by a tight radius about the apparatus sufficiently warm.

In a preferred form, a cover member is provided above the housing with the cover member extending radially beyond the housing to protect it from exposure to precipitation. The cover member is spaced above the emitter surface along the longitudinal axis to reflect stray radiant heat that rises above the housing back in the downward direction around the longitudinal axis. Preferably, the heating apparatus includes an elongate support member projecting up to the burner assembly housing, and the cover member has a predetermined diameter transverse to the longitudinal axis that is less than approximately 2½ feet in length. Prior dome reflectors are much larger than the cover member of the present heating apparatus with the large size being necessary to reflect the heat from the cylindrical wall of the burner assembly housing. The provision of the present inclined emitter surface substantially eliminates the need for the large dome reflector of the prior patio heaters such that a much smaller cover member can be used, as described above.

In one form, the heating apparatus includes a base sized to contain a fuel tank therein with the burner assembly housing being substantially smaller than the base, and an elongate support member extending between the base and the housing along the longitudinal axis. Detachable connections are provided between the support member, the base, and the housing to allow for transportation storage in a compact manner.

Preferably, the emitter surface is flat and is inclined at a predetermined angle from the longitudinal axis to direct heat downward and radially outward from the longitudinal axis. The predetermined angle can be approximately 70° for maximizing the coverage of heated air throughout the preselected area.

In a preferred form, the emitter surface has a frustoconical shape for directing heat downward and radially outward from the longitudinal axis, and the housing further includes an upper cylindrical wall portion projecting upward from the top of the frustoconical emitter surface.

In another form of the invention, an upper housing assembly for a heating apparatus is provided with the upper housing assembly containing a burner head for ignition of fuel supplied thereto from a fuel source. The housing assembly includes a cylindrical wall portion having a central longitudinal axis extending therethrough, and apertures in the cylindrical wall portion for emitting hot gases created by the ignited fuel. At least one louver extends transverse to a longitudinal axis and is adjustably attached to the housing wall portion to allow the position of the louver to be changed relative to the axis for directing heat emanating from the wall and apertures thereof in a generally downward direction. The louver allows the burner assembly housing of the prior commercially available patio heaters to be employed while eliminating the need for the large dome reflector hoods attached thereover, and substantially minimizes the loss of radiant heat directed out radially from the housing without being reflected by the dome. In addition, the adjustable louver allows for the area being heated by the heating apparatus to be altered in accordance with the specific needs of the user(s).

Preferably, the heating apparatus includes a base for containing a fuel tank with the base having a predetermined radius, and the distance from the central axis to the louver distal end is shorter than the base radius so that the louver is sized to fit inside the base for transport.

In a preferred form, the at least one louver includes multiple louvers that are adjustable relative to each other to change the spacing between adjacent louvers and for minimizing the risk of accidental contact with the hot wall of the housing assembly.

In one form, the louver has an annular body portion inclined downward relative to the central axis, and a bent portion spaced from the housing wall portion that is inclined downward relative to the annular body portion. Preferably, there are provided multiple louvers that are adjustable relative to each other to change the spacing between adjacent louvers, and the louver annular bodies and bent portions have predetermined radial lengths with the radial length of the annular body being approximately twice the spacing between adjacent louvers and approximately four times that of the radial length of the bent portion.

In another form of the invention, a heating apparatus for controllably heating different areas about the apparatus is provided including a burner assembly for igniting fuel from a fuel source and a housing for the burner assembly having an apertured wall extending about the burner assembly to emit heat from the housing. A heat reflector hood is provided which is larger than the housing in a radial direction and is disposed above the housing wall for directing rising heated air from the housing downwardly to heat a preselected area below the hood. A heated area adjuster is provided under the hood and is adjustable to deflect heat for changing the preselected area being heated by the heat from the housing. The heated area adjuster allows heat from the housing to be concentrated in areas about the heating apparatus where it is needed, whereas areas that are not used, and thus do not need to be heated, are not heated.

Preferably, the heated area adjuster includes a baffling mechanism adjacent the housing wall which is shiftable between first and second positions so that with the baffling mechanism in the first position substantially the entire extent of the reflector hood is utilized to direct heated air from the housing to heat the preselected area, and with the baffles shifted to the second position less than substantially the entire extent of the reflector hood is utilized to direct heated air from the housing to heat a different preselected area. The baffling mechanism can include pivotable baffles that are pivoted closed in the first position, and are pivoted open in the second position.

In one form, the heated areas adjuster may include a heat diverter adjacent the housing wall with the heat diverter being adjustable to block heat from a portion of the reflector. The heat diverter is adjustable to a plurality of different positions for varying the size of the reflector portion blocked from heat to change the preselected area that is heated.

DETAILED DESCRIPTION OF THE PREFERRED EMBODIMENT

Figure 1:
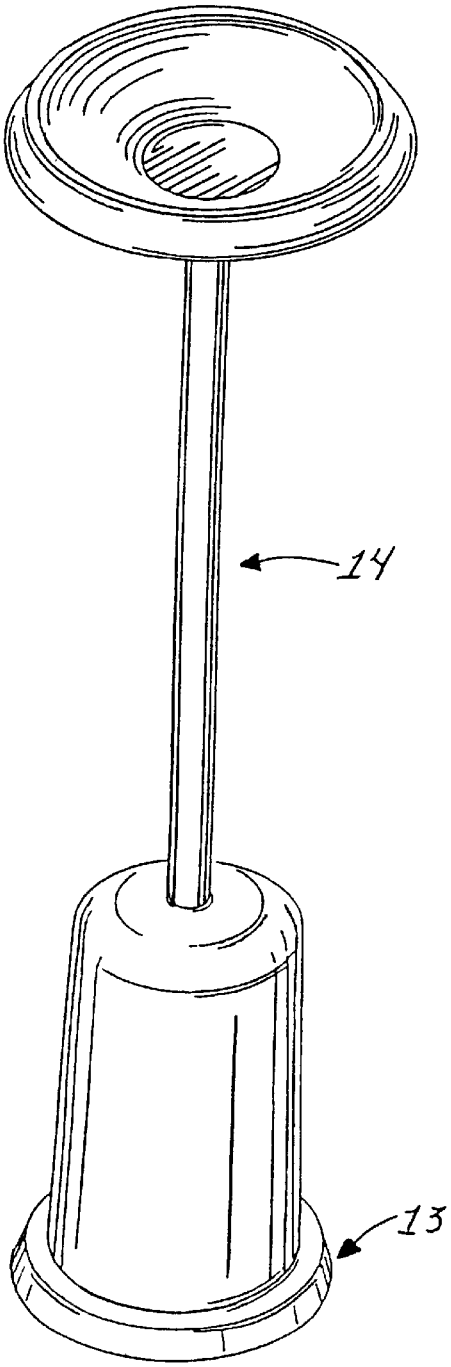
FIG. 1 is perspective view of a heating apparatus in accordance with the present invention showing a cover member and a base with an elongate support extending therebetween.
Figure 2:
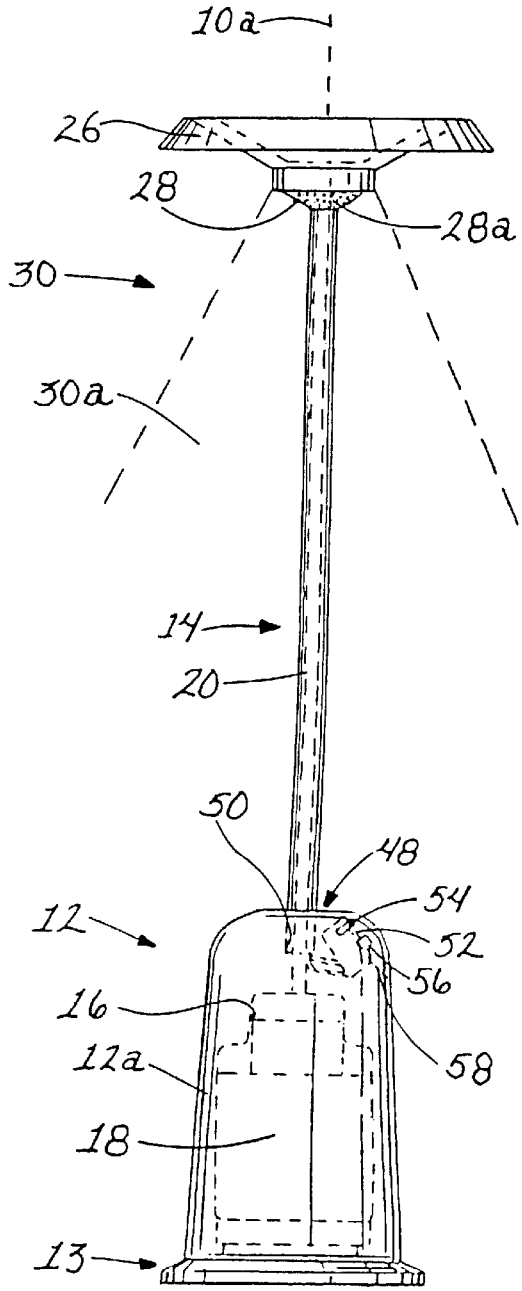
FIG. 2 is an elevational view of the heating apparatus of FIG. 1 showing a fuel tank in the base with a gas feed line extending in the support member, and a burner assembly housing having an inclined apertured emitter surface at the top of the support member under the cover member.
Figure 3:
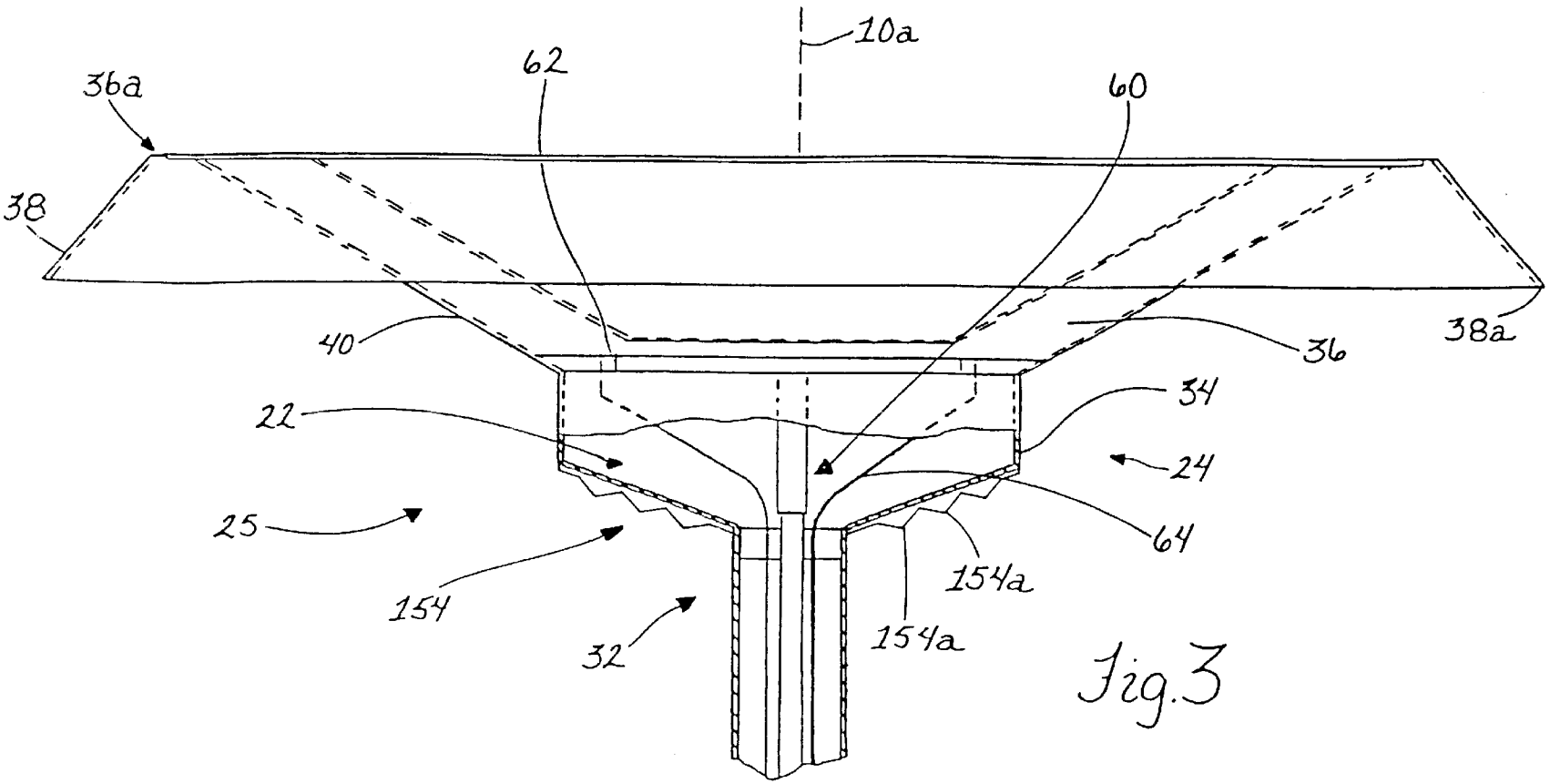
FIG. 3 is an enlarged fragmentary elevational view of the arrangement of the burner assembly housing and the cover member and showing the housing partially broken away for viewing of the burner assembly therein.

In FIGS. 1–3, a high-efficiency heating apparatus 10 in accordance with the present invention is illustrated. The heating apparatus 10 is adapted to utilize natural or LP gas as fuel to generate heated air by the hot gases of combustion and radiant infrared heat for keeping an area about the apparatus 10 heated. The apparatus 10 is often termed a "patio heater" as it is designed primarily for outdoor use such as during nighttime in patio areas outside of taverns and bars so that patrons can spend time outdoors in a comfortable preselected area which is warmer than the colder outdoor temperature. As shown, the patio heater 10 has a base 12 at the bottom of elongate support member or standard 14. The base 12 has an interior space 16 for containing LP tank 18 therein, as shown in FIG. 2.

The base interior 16 can be sized so as to fit a standard 20 lb LP cylinder 18 therein. In one form shown in FIGS. 1 and 2, the base 12 has an upper shroud portion 12*a* which is of a HDPE thereformed material with the interior 16 cutout so as to snugly fit the LP tank 18 inside the base 12. A lower support flange 13 of steel material such as, for example, an 11 gauge steel having a wall thickness of approximately 0.250 inch can be provided at the bottom of the upper plastic portion 12*a* of the base 12. As shown, the bottom support flange 13 has a larger diameter than the upper plastic portion 12*a* of the base 12 and supports the bottom of the tank 18 thereon in the base interior 16. Where the tank 18 is a standard 20 lb LP cylinder, the diameter for the flange 13 at the bottom thereof can be approximately 20.60 inches with a height of approximately 2.50 inches.

The standard 14 preferably is hollow so that a gas line 20 can be run therethrough from the tank 18 up to burner assembly 22 contained in a housing 24 therefor, as seen generally in FIG. 3. It is also contemplated that the heating apparatus 10 can be connected to an underground gas line such as provided by a gas utility with the standard 14 anchored in the ground and the gas line 20 connected to the underground utility line thus eliminating the need for the base 12 housing the LP tank 18.

In the apparatus 10, and the other high efficiency heating apparatuses 65, 94 and 200 to be described more fully hereinafter, there is included a high efficiency system, generally designated 25, that maximizes the amount of heat emanating from the burner assembly housing 24 that is used for heating of a preselected area about the apparatus. The heat efficiency system 25 minimizes the loss of heat or the heating of areas that is otherwise unnecessary as can occur with prior patio heaters. In this manner, the heat efficiency system 25 minimizes the amount of fuel that is consumed for heating of the area that is desired to be warmed.

Referring more specifically to FIGS. 2 and 3 with respect to apparatus 10, there is shown the arrangement of a cover member portion 26 that is formed integrally with or otherwise attached in superimposed relation over the housing 24 for the burner assembly 22. The support standard 14, base 18, housing 24 and cover 26 are all aligned along a central, longitudinal vertical axis 10*a* of the apparatus 10. The cover member 26 serves primarily to protect the burner assembly housing 24 from exposure to the outdoor environment such as rain, snow, etc., and also reflects stray radiant heat that rises above the housing 24 back down around the support standard 14 and base 18 of the apparatus 10, and specifically about the apparatus vertical axis 10*a,* as will be more fully described hereinafter. Unlike prior patio heaters that use very large reflector domes, the present heating apparatus 10 can have a much smaller cover member 26 as the burner assembly housing 24 is constructed so as to minimize the amount of stray heat that will emanate therefrom.

More particularly, the heat efficiency system 25 of apparatus 10 includes an emitter surface 28 of the housing 24 that is inclined relative to the longitudinal axis 10*a* so as to face in a generally downward and radially outward direction; that is, in the direction of area 30 below the cover member 26 about axis 10a that is desired to be heated. The emitter surface 28 has apertures 28*a* formed therein to allow the hot gaseous products of combustion generated by the burner assembly 22 to escape from the housing 24. The emitter surface 28 preferably is of an 18 gauge stainless steel material so that the flow of hot gases through the apertures 28*a* thereof heats up the surface 28 sufficiently so as to generate radiant infrared heat that emanates therefrom.

Because the emitter surface 28 is angled so as to face in a generally downward and radially outward direction, the heat emanating therefrom will also generally be directed in the downward and radially outward direction so as to heat the preselected area 30 about the apparatus longitudinal axis 10*a*. The heated area 30 includes a main region 30*a* that primarily gets its heat directly from the inclined emitter surface 28 and has a generally conical-shape with a progressively widening radius down along the apparatus axis 10*a,* as indicated with dashed lines in FIG. 2. In this regard, the housing 24 and specifically the emitter surface 28 thereof provides for greater efficiency in heating the area 30 over prior commercially available patio heaters having a vertically oriented cylindrical emitter surface which produces heat that radiates radially outward therefrom and only some of which is reflected downward in the desired direction by the large dome reflector thereover, as previously discussed.

The cover member 26, while serving to reflect stray radiant heat from the housing 24, has as its primary purpose the protection of the housing 24 from the elements and thus can be significantly smaller in size, in particular in the radial direction versus the reflector domes used with prior patio heaters. In addition, as the cover member 26 does not have radiant heat focused directly thereat, the cover member 26 as shown in the preferred and illustrated form can be completely vertically spaced above the housing 24. In this regard, the cover member 26 can also be smaller in terms of its height in the longitudinal direction versus prior dome reflectors as it does not need to extend down to overlap over the inclined emitter surface 28. Due to the relatively small size of its cover member 26, the apparatus 10 is particularly well-adapted for retail sale, as it can be compactly packaged for fitting on retail shelf space and into trunks of automobiles after purchase.

Figure 3A:
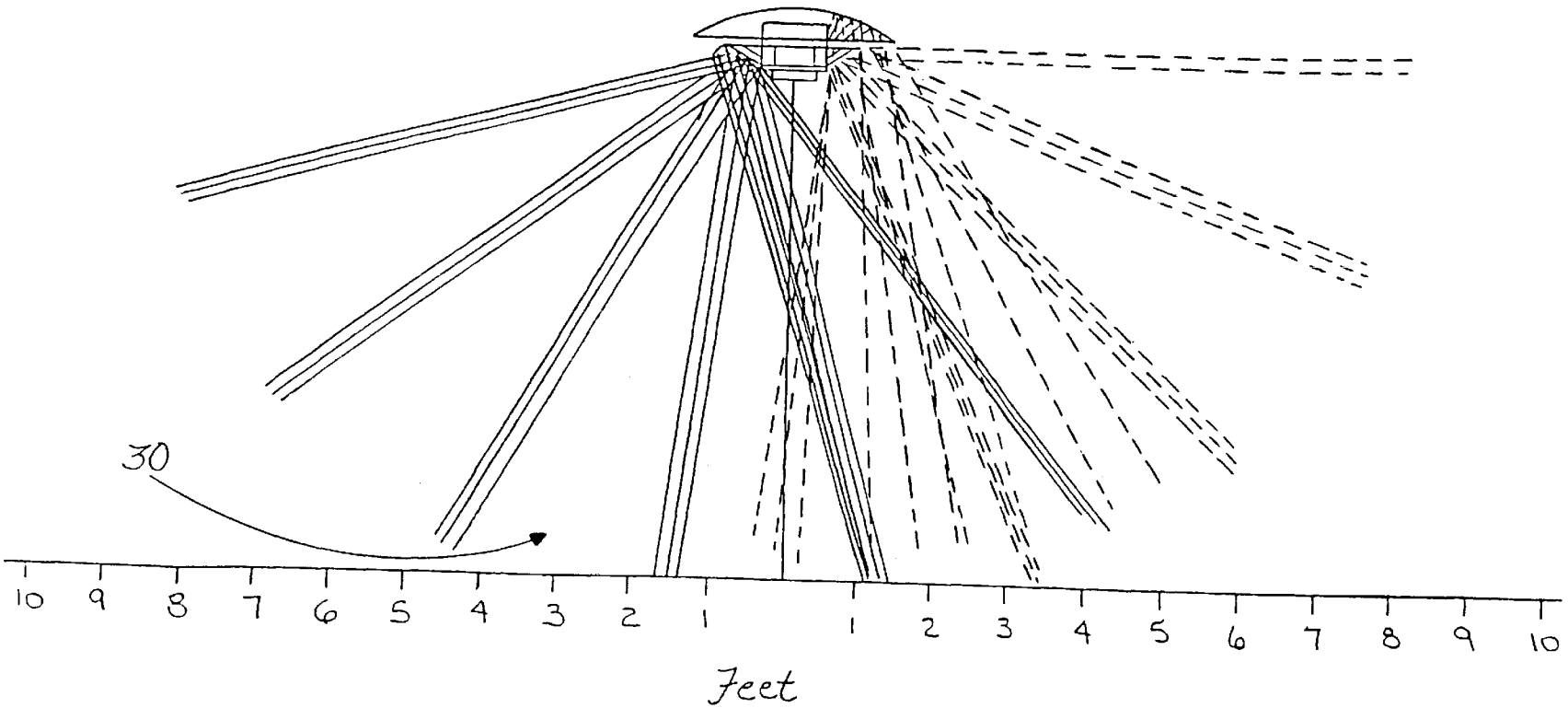
FIG. 3A is a view showing the different heating effect gained by the present heating apparatus of FIGS. 1–3 over prior heaters having a cylindrical emitter surface.

Referring to FIG. 3A, the differences between the heat efficiencies of a conventional patio heater and the present patio heater 10 with angled emitter surface 28 are schematically illustrated. As can be seen, more heat emanating from the housing 24 of the present heater 10 is concentrated in a tight radius about the axis 10*a* with this radiant heat depicted in solid lines, over the concentration of radiant heat from the housing of the prior heater which is shown in dashed lines. Where the height to the juncture of the housing 24 and cover member 26 is approximately 86 inches versus taller prior heaters e.g. approximately 92 inches in height, it has been found that the present heater 10 provides a much greater focus or concentration of heat about a tight radius around the central vertical axis 10*a* of the apparatus 10, e.g. approximately 2–3 feet.

More of the details of the construction of the illustrated apparatus 10 will next be described. The burner assembly housing 24 can be attached at top 32 of the vertical support pole 14 with the inclined emitter surface 28 being a flat and smooth surface that is perforated with a plurality of apertures 28*a*. The surface 28 tapers up and radially out away from pole top 32 such that it has a generally frustoconical shape. Manifestly, other shapes for the emitter surface 28 that direct heat generally downward and radially outward are also within the purview of the present invention, e.g. a curved emitter surface such as forming a parabolic shape.

Projecting up from the top end of the surface 28 is a short, non-perforated upper cylindrical wall portion 34 of the housing 24. The cover member 26 is secured so that it is above the housing cylindrical portion 34, as can be seen in FIG. 3. More particularly, the cover member 26 is attached to the top of the cylindrical portion 34 at the bottom of an upwardly opening generally concave or dish-shaped main central portion 36 thereof. At the radial outer end 36*a* of the cover member portion 36, a downturned annular lip flange 38 is formed, such as of an aluminum material. In the preferred form, the bottom 38*a* of the flange 38 is spaced vertically above the-top of the housing cylindrical portion 34 as there is no overhang that is necessary because the cover member 26 does not have heat that is focused out radially directly thereat as with prior patio heaters having cylindrical emitter surfaces large dome reflectors. In addition, the cover member 26 can be greatly reduced in size, particularly in the radial direction transverse to the apparatus longitudinal axis 10A e.g. approximately 26 inches in diameter across the bottom 38*a* of the cover member lip 38 versus prior 34½ inch diameter dome reflectors while still extending radially sufficiently beyond the housing 24 so that it is protected from rain and snow.

As previously discussed, the cover member 26 has as one of its functions the ability to reflect stray radiant heat that emanates from its housing 24 and rises thereabove back down about the apparatus 10 to heat the preselected area 30 below the cover member 26. In this regard, the cover member dish-shaped portion 36 preferably includes smooth and flat inclined surface 40 on the underside thereof. The inclined surface 40 similar to the housing surface 28 is inclined relative to the longitudinal axis 10*a* so that it faces in a generally downward and radially outward direction for reflecting heat accordingly. In the illustrated form as best seen in FIG. 3, the inclination of surface 40 from the vertical axis 10*a* can be slightly less than that of the surface 28. By way of example and not limitation, surface 28 can be inclined at an angle of approximately 70° from axis 10*a* while surface 40 is inclined at an angle of approximately 60° from axis 10*a*. The downturned lip 38 also assists in catching and reflecting rising radiant heat from housing 24 such as heat that may rise up along surface 40 and redirecting it back down so that it reflects off surface 40 into area 30 to be warmed or directly travels into the area 30 about axis 10*a* off the lip 38, as schematically shown in FIG. 3A.

It has been found with the above-described construction for the housing 24 and cover member 26, the heating apparatus 10*a* maximizes the coverage of heated air throughout the preselected area 30 below the cover member 26 for efficient heating thereof. In other words, substantially all of the heat generated by the burner assembly 22 and emanating from housing 24 is used for heating of the area 30 without any significant amounts of heat being lost out radially from the cover member 26 such as with the cylindrical apertured wall of-prior commercial patio heaters.

Figure 4:
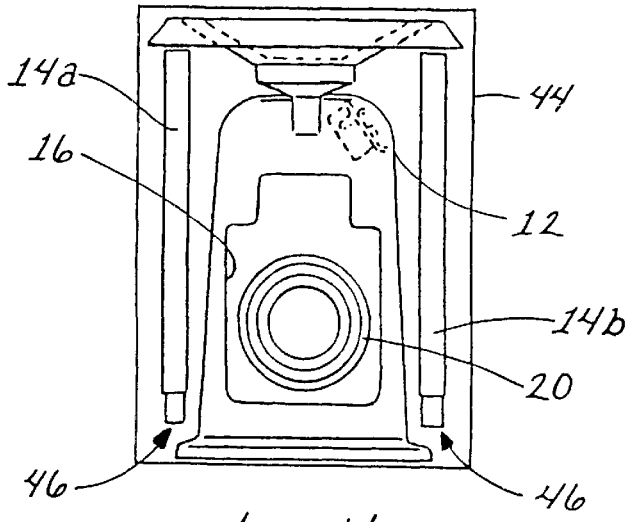
FIG. 4 is an elevational view of a shipping container containing the broken down heating apparatus of FIGS. 1–3.

Preferably, the heating apparatus 10 can be broken down so that it can be stored and shipped in a compact and cost-efficient manner. Referring to FIG. 4, there is shown a shipping container 44 sized to contain all the parts of the heating apparatus 10 herein. The standard or vertical pole 14 for the apparatus can be provided in two equal length pole sections 14*a* and 14*b* with swedges 46 formed at ends of the sections 14*a* and 14*b* for forming a detachable connection therebetween. Further detachable connections similar to that between pole sections 14*a* and 14*b* can be provided at the top 32 of the standard 14 between it and the housing 24, and at the bottom 48 of the standard 14 where it is tightly received in a central recess 50 formed at the top of the base 12.

The gas feed line 20 can be of a flexible aluminum material, such as, for example, in the form of an aluminum line having a ⅜ inch diameter with a wall thickness of 0.032 inches, so that it can be coiled for placement into the cut-out interior 16 of the base 12. Accordingly, where the base 12 is sized to fit a 20 lb. LP cylinder 18, it preferably will have a diameter at the bottom of its support flange 13 of approximately 20.60 inches, as previously mentioned. In this form, the apparatus 10 preferably will have a height from the bottom to the juncture of the housing 24 and cover member 26 of approximately 86 inches, and the outer diameter of the cover member preferably will be less than 2½ feet in length or approximately 26 inches. With the sizes as set forth above, the dimensions of the shipping container 24 can be 27 inches by 27 inches by 36 inches with a 15.2 cubic foot volume therein for containing all the different parts of the present patio heater apparatus 10 including the base 12 with the gas line 20 coiled therein, the standard sections 14*a* and 14*b*, and the housing 24 and cover member 26 assembly. In this regard, the present apparatus 10 allows a very compact shipping container such as container 44 to be utilized for achieving significant savings in transportation costs, and also reducing the costs associated with storage of the various parts of the apparatus 10.

Returning to FIGS. 2 and 3, the burner assembly 22 and controls therefor will next be described in more detail. A control panel 52 is provided and includes an ignitor actuator 54 and a gas valve control knob 56 mounted thereon. The control panel 52 can be disposed in a cutout 58 formed at an upper corner of the base 12 so that the control panel 52 is recessed therein. Burner head 60 is fed gas from fuel tank 18 via gas line 20 with the gas flow being regulated by the valve control 56. An ignitor element 62 preferably of the piezoelectric type ignites the gas when the piezo ignitor actuator 54 is depressed. A safety shut off is provided as controlled by thermocouple 64 which is sensitive to temperature variations, and will cause an open gas valve (not shown) to close when the flame in the burner head 60 is extinguished for any reason with the gas valve control 56 turned on. In this manner, the flow of gas through gas line 20 will be shut off when there is no flame present at the ignitor 62 so as to prevent the dangerous accumulation of non-combusted fuel gases in and around the housing 24.

Figure 5A:
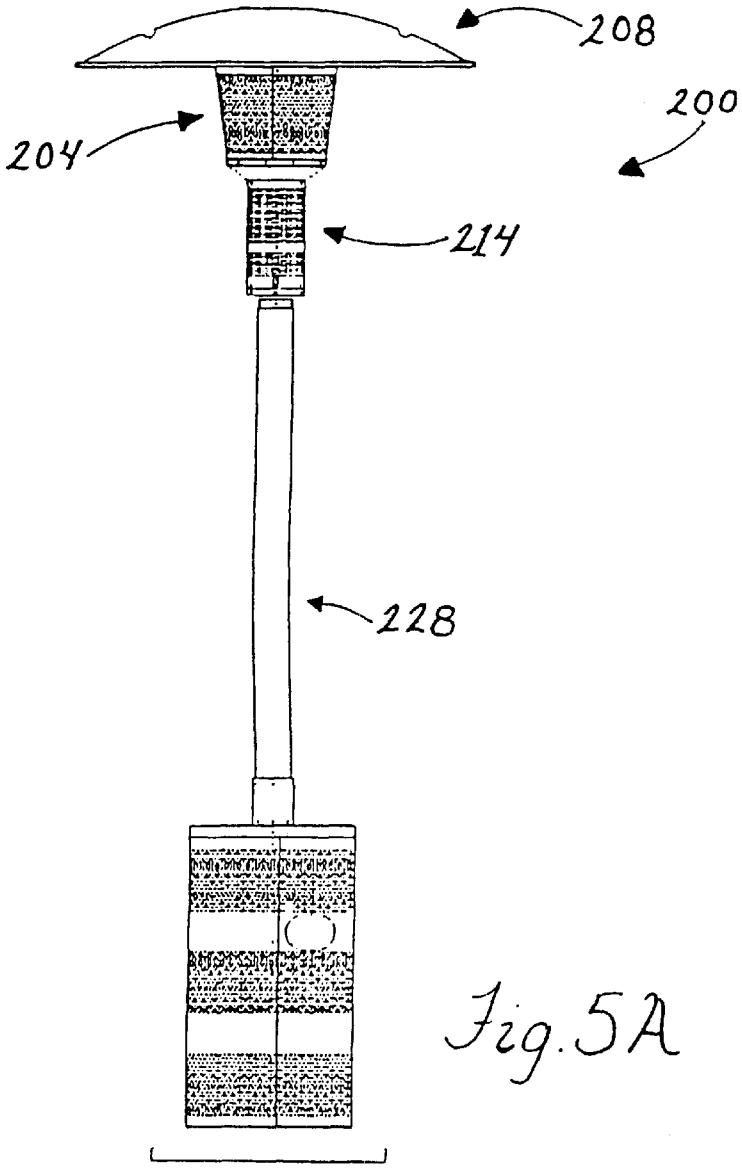
FIG. 5A is an elevational view of an alternative heating apparatus in accordance with the invention including a frustoconical emitter screen.
Figure 5C:
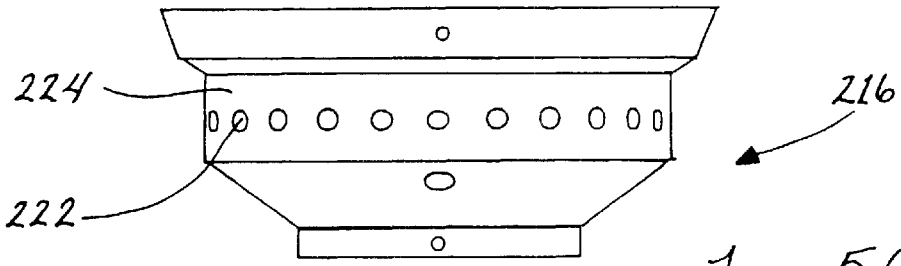
FIG. 5C is an enlarged elevational view of a bottom member of the emitter assembly showing relief holes formed therein.
Figure 5B:
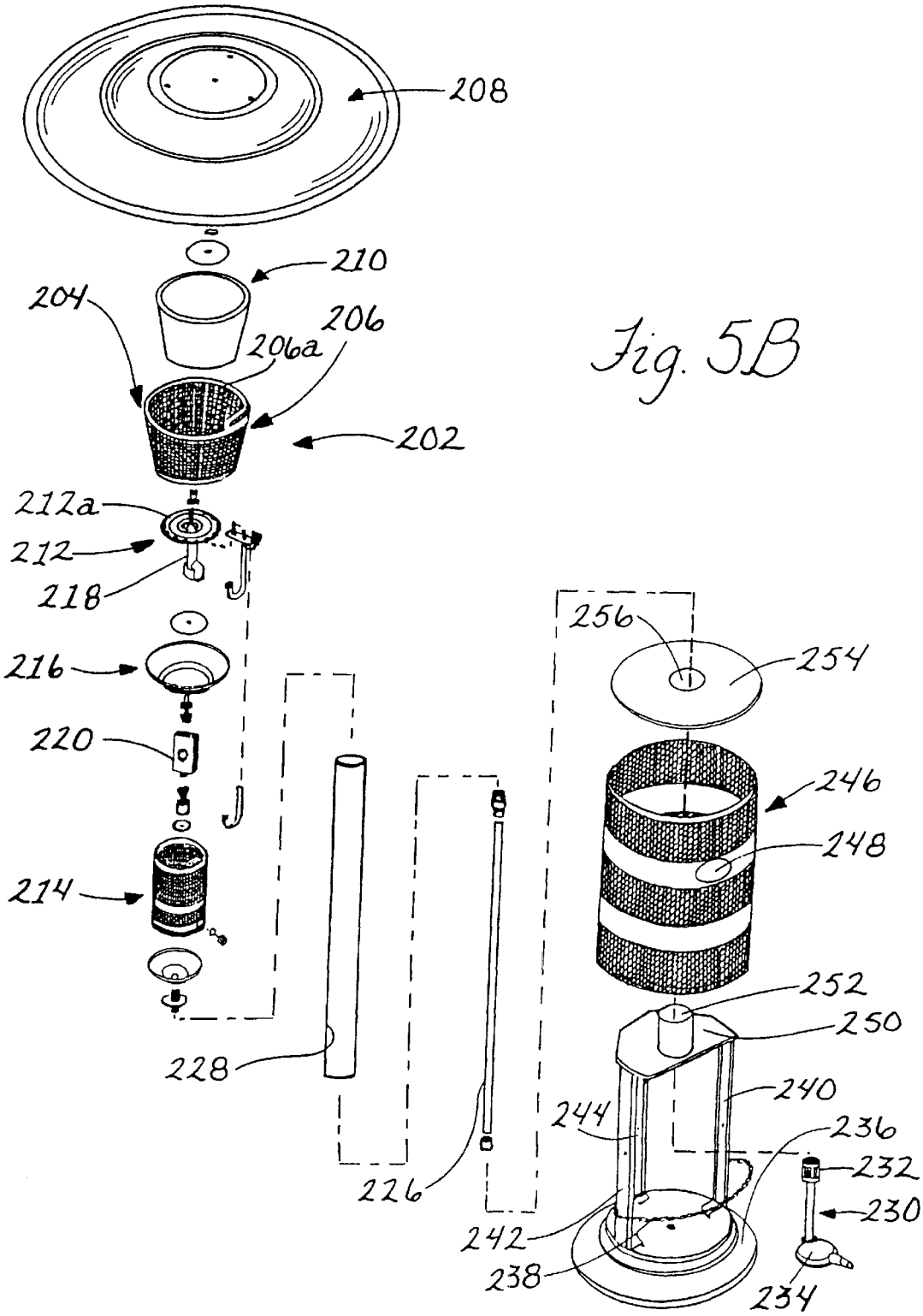
FIG. 5B is an exploded perspective view of the alternative heating apparatus of FIG. 5A showing an emitter assembly including the frustoconical emitter screen for radiating heat in a generally downward and radially outward direction.

Referring to FIGS. 5A and 5B, an alternative high efficiency heating apparatus 200 including a high efficiency system 25 is shown in exploded form to illustrate its various components, one of which is emitter assembly 202 having frustoconical emitter screen or grid 204 for providing an inclined emitter surface 206 having small apertures 206a formed therein similar to previously-described inclined emitter surface 28 of apparatus 10. In this regard, the apparatus 200 including inclined emitter surface 206 provides heating efficiency advantages over prior cylindrically-shaped emitter surfaces. As discussed with respect to inclined apertured surface 28, the inclination of surface 206 is such that heat radiates therefrom in a generally downward and radially outward direction and directly into the area intended to be warmed with minimal heat losses into areas that are not intended to be warmed. The preferred inclination of surface 206 for maximum coverage and heat efficiencies is 20° from the vertical axis of the apparatus 200.

In the apparatus 200, a large dome reflector 208 is utilized for reflecting any stray radiant heat that may radiate upward from the emitter assembly 202. The reflector 208 is similar in size to the large prior domed reflectors described earlier. Insofar as the inclination of emitter surface 206 directs radiant heat into the area to be warmed without the need for a large reflector member, the dome reflector 208 mainly serves to distinguish the apparatus 200 from the retail-oriented apparatus 10 in that the apparatus 200 is intended to primarily be offered for sale to commercial customers. As best seen in FIG. 5A, even though the reflector hood 208 does not overlap to any significant extent in a radial direction the emitter screen 204, the issues of heat loss and heating inefficiencies created thereby with cylindrical emitters are not of concern due to the inclination of the surface 206.

Turning to more of the details of the construction of apparatus 200, the emitter assembly 202 includes an inner cone member 210 of an insulative material that fits in the outer emitter grid 204 and contains the flame from burner head 213 from accessing valve housing 214. More specifically, the burner head 212 is attached at the bottom of the inner cone member 210 such that the peripheral ports 212*a* of the burner head 212 are generally aligned with the inclined annulus formed between the emitter grid 204 and the inner cone member 210. An emitter bottom member 216 is secured between the bottom of the apertured grid 204 and the valve housing 214. The neck 218 of the burner head 212 extends through the emitter bottom member 216 and is connected to the top of the gas valve unit 220 disposed in the cylindrical valve housing 214. Thus, the insulation cone member 210 contains the flames formed at burner head ports 212*a* in the annular space between the grid 204 and the inner insulation cone 210 and from being blown down into the valve housing 214 and heating up the valve unit 220.

To minimize the influence of wind and for reducing built-up pressure inside the emitter assembly 202, the emitter bottom member 216 can be provided with a plurality of relief openings 222 circumferentially spread about the various portions of the member 216, as can be seen in FIG. 5C. In the preferred and illustrated form, the intermediate cylindrical portion 224 has the majority of the openings 222 formed therein with preferably twenty five such relief openings 222 spaced evenly about the circumference thereof. The relief openings 222 help stabilize the apparatus 200 against tipping during windy conditions and prevent blow outs of the pilot and burner head flame. Further, pressure built-up inside the emitter assembly 202 can be relieved through the relief openings 222 so as to reduce the tendency for the flames to be drawn into the valve housing 214.

Referring again to FIG. 5B, a gas feed line 226 runs through standard 228 and at its top is connected to the bottom of the valve unit 220 via respective unions. The bottom of the gas line 226 is connected to the top of a regulator hose assembly 230 via quick disconnect fitting 232. Regulator 234 of the assembly 230 can be fit to the valving at the top of the LP cylinder (not shown) resting on base flange 236 and maintained thereon by way of restraint chain 238 hooked to upstanding base legs 240 and 242 and in conjunction with third leg 244.

A large cylindrical shroud 246 is sized to rest on top of the base flange 236 and fit around and over the legs 240–244 and the cylinder disposed therebetween. The shroud 246 is perforated to provide for air flow therethrough. The shroud 246 is also provided with an opening 248 toward the upper end thereof to provide access to the valving of the cylinder therein without having to lift the shroud 246 over the cylinder to turn the heater on and off as with prior patio heaters.

A platform 250 is mounted across the top ends of the legs 240–244 and has a mounting sleeve 252 thereon. A cover 254 closes off the top of the shroud 246 and has a central opening 256 through which the sleeve 252 projects for receipt of the bottom end of the standard 228 therein. With the standard 228 resting on the platform 250, set screws (not shown) threaded through the sleeve 252 can be tightened to secure the standard 228 therein.

FIGS. 6–9 illustrate another high efficiency heating apparatus 65, and specifically an upper portion 66 thereof using the previously-described large reflector hood 68 which as mentioned is dome-shaped and curves so that it opens downwardly about a burner assembly housing 70 having a perforated cylindrical emitter surface 72. As previously discussed, the use of the large reflector hood 68 having its lower edge 74 aligned with approximately the mid-point of the emitter surface 72 causes significant inefficiencies in terms of the heat loss and amount of fuel required to heat a given area. Moreover, there are often times when the entire 360° circumference about the standard 74 need not be heated such as when the apparatus 65 is adjacent a corner making it more difficult for people to stand around the entire unit 65.

Accordingly, the heat efficiency system 25 of apparatus 65 includes a heated area adjuster 78 associated with the dome reflector hood 68 and housing 70 and which is adjustable to reflect heat emanating from the housing 70 to change the preselected area that is heated about the standard 74.

Figure 6:
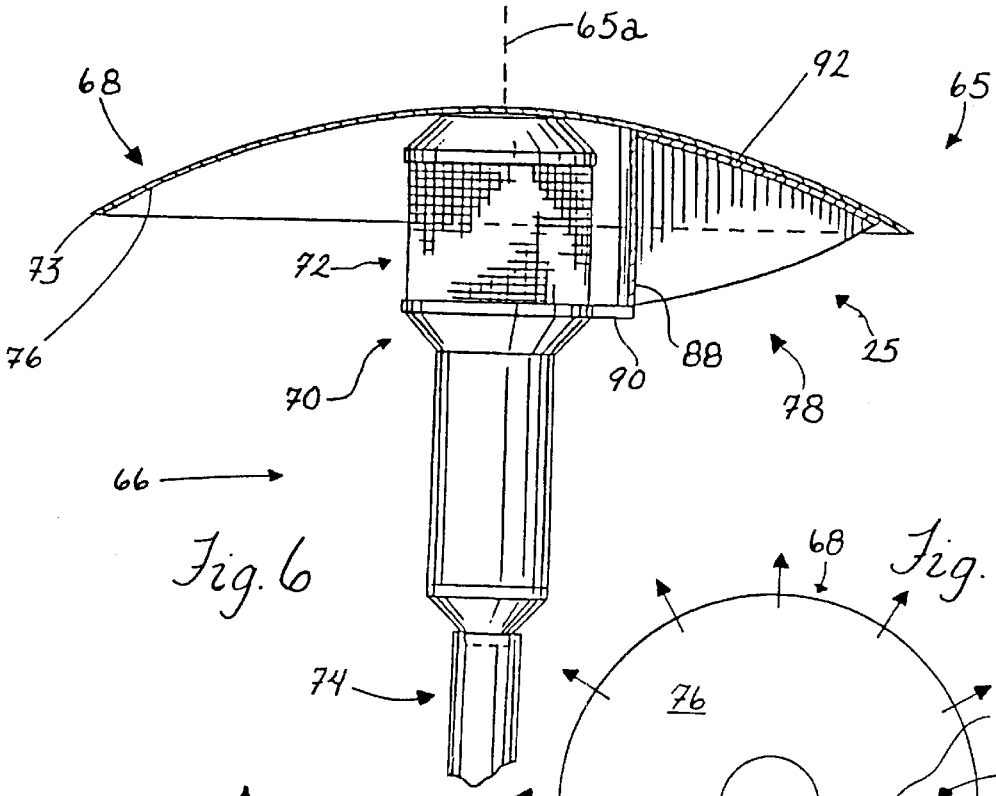
FIG. 6 is a fragmentary elevational view of an upper portion of another heating apparatus in accordance with the invention showing a burner assembly housing and reflector hood arrangement, and a heated area adjuster under the hood adjacent the housing which allows the preselected area being heated by the apparatus to be varied.
Figure 7:
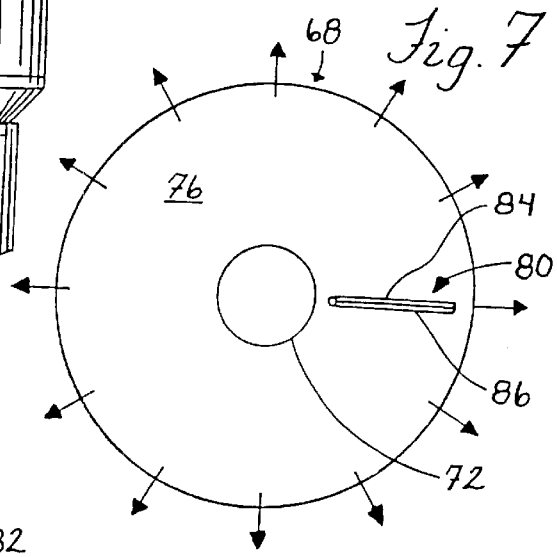
FIG. 7 is a bottom plan generally schematic view of the heating apparatus of FIG. 6 showing pivotable baffles of the heated area adjuster closed so that substantially the entire extent of the underside of the reflector hood is utilized to reflect heat from the housing to heat the preselected area.
Figure 8:
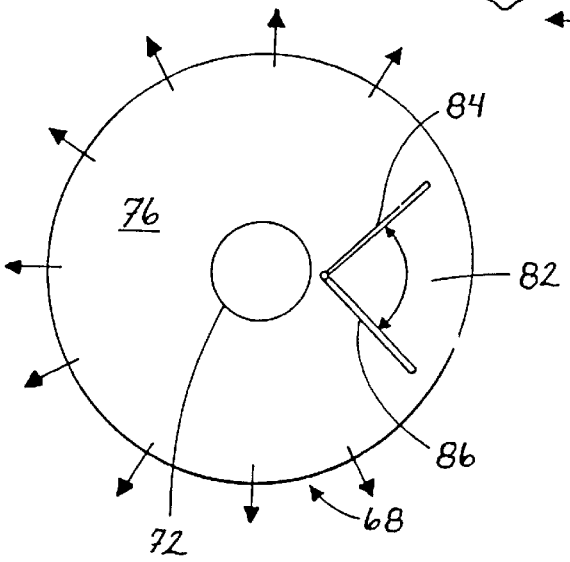
FIG. 8 is a view similar to FIG. 7 showing the baffles pivoted open in perpendicular relation to each other so that less than the entire extent of the reflector hood is utilized to reflect heated air from the housing to heat a different. preselected area.

More particularly, the heated area adjuster 78 can take the form of a heat diverter or baffling mechanism 80 which is mounted adjacent the housing wall 72 and which is adjustable for blocking heat from a portion 82 of the bottom surface or underside 76 of the reflector hood 68. Referring to FIGS. 6–8, the diverter 80 can be adjusted to a plurality of different positions which varies the size of the reflector portion 82 on the underside 76 of the hood 68 that is blocked from heat emanating from the housing 70 so as to change the preselected area that is heated by the heating apparatus. In this regard, the heat diverter or baffling mechanism 80 is shiftable between first and second positions whereby with the mechanism 80 in the first position (FIG. 7), substantially the entire extent of the underside 76 of the hood 68 is used to reflect heat from the housing 72 for heating the entire 360° circumference about the standard 74 under the hood 68. To change the area being heated, the mechanism 80 can be shifted to its second position (FIGS. 8 and 9) so that less than the entire 360° circumference on the underside 76 of the reflector hood 68 is used for reflecting heated air from the housing 72 which accordingly causes less than a 360° area about the standard 74 under the hood 68 to be heated.

As shown, the baffling mechanism 80 can include a pair of pivotal baffle members 84 and 86 that are pivotally attached at one end to a pivot shaft 88. The pivot shaft 88 can be supported on platform extension 90 projecting radially from near the bottom of the burner assembly housing 70, and can be attached at its top end to the bottom surface 76 of the reflector hood 68, as shown in FIG. 6.

The baffle members 84 and 86 can have a generally triangular-shape with their upper and lower sides bowed slightly outwardly. As can be seen in FIG. 6, the curvature of the top side 92 matches the curvature of the underside 76 of the reflector hood 68 so that heat generally cannot rise over and past the baffles to gain access to the blocked surface portion 82 of the hood 68 and be reflected downwardly thereby. The base side of the triangular baffles 84 and 86 is pivotally attached at the pivot shaft 88 for pivoting of the baffles 84 and 86 thereabout.

To adjust the area that is being heated by the heat emanating from the emitter surface 72, the baffles 84 and 86 can be pivoted open about pivot shaft 88 to vary the size of the portion 82 of the reflecting surface 76 of the hood 68 that has heat diverted therefrom by the baffles 84 and 86 which, in turn, adjusts the area under the hood 68 that will not be heated to the same extent as the remainder of the heated area keeping in mind that some heat may flow to areas which are not to be heated such as due to winds or other forces. Nevertheless, it will generally be true that the area immediately under the pivoted open baffles 84 and 86 and thus under the surface portion 82 of the reflector hood 68 will not see the same degree of heating as that area under the remainder of the hood 68.

Figure 9:
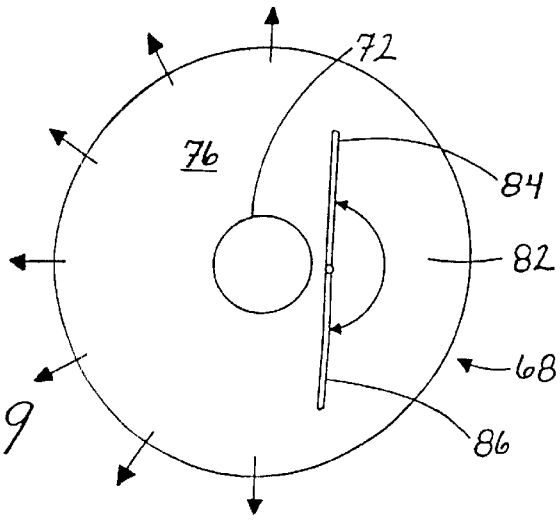
FIG. 9 is a view similar to FIG. 8 showing the baffles completely open so that they are aligned with each so that even less of the hood is utilized to reflect heat for further varying the area that is to be heated.

The baffles 84 and 86 can be retained in their pivoted open positions by the friction of their pivotal mounting to the shaft 88 or by frictional engaugement of the curved top side 92 of the baffles 84 and 86 with the hood underside 76, or by any other suitable means. Thus, the pivotal baffle members 84 and 86 allows substantially the entire 360° extent of the bottom surface 76 of the reflector hood 68 to be utilized for reflecting heat from the housing 70, as depicted in FIG. 7, or can be pivoted to and maintained in their full open position during operation of the apparatus 65 as shown in FIG. 9 where the baffle members 84 and 86 are in alignment with each other thus blocking off surface portion 82 from heat emanating from housing 70 so that only the remaining portion of the surface 76 less the blocked off portion 82 is used for reflecting heat from the housing 70, or to various positions therebetween such as where the baffles 84 and 86 are pivoted to be in right angle relation to each other and maintained thereat during operation of the apparatus 65 as shown in FIG. 8 with the blocked off surface portion 82 accordingly being smaller than when the baffles 84 and 86 are pivoted fully open as in FIG. 9. Accordingly, the baffles members 84 and 86 can be adjusted to a plurality of different positions for varying the size of the reflector surface portion 82 which is blocked from heat so as to allow for adjustment of the preselected area that is heated by the apparatus 65 so that only areas in which people can gather about the apparatus 65 will be heated and such that heat will not be directed to those areas about the apparatus 65 that are inaccessible so that heat and fuel are not wasted.

Figure 10A:
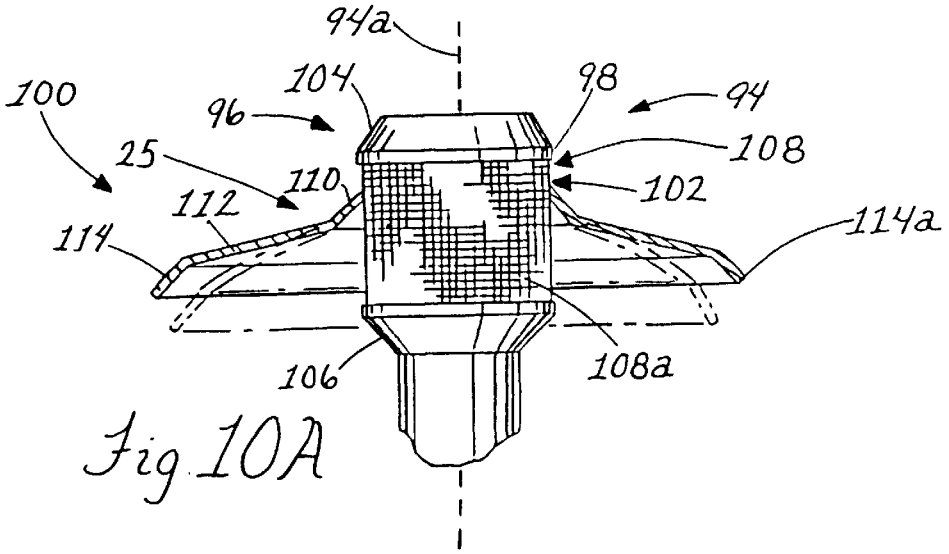
FIG. 10A is a fragmentary elevational view of an upper portion of another heating apparatus in accordance with the invention showing a louver adjustably attached to the burner assembly housing for changing the inclination of the louver to vary the area being heated.
Figure 10B:
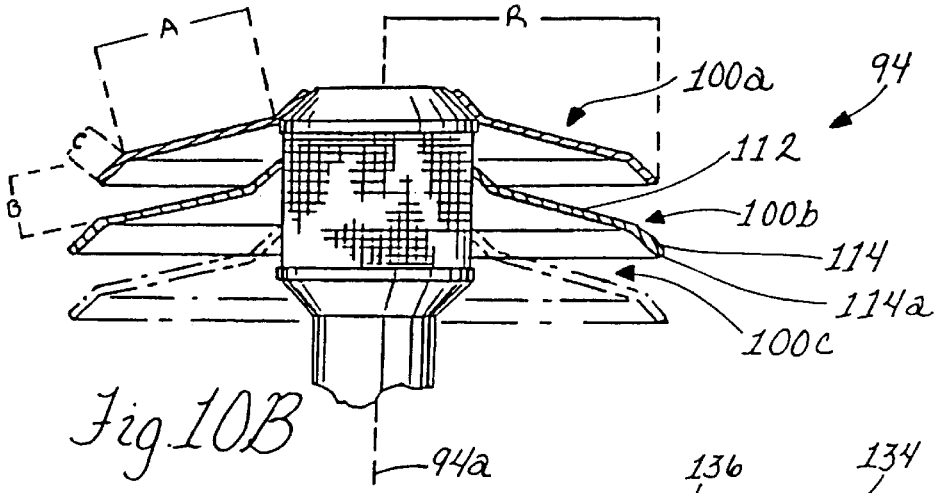
FIG. 10B shows a plurality of louvers adjustably attached to the burner assembly housing.

Another high efficiency heating apparatus 94 is shown in FIGS. 10A and 10B, and in particular upper housing assembly 96 thereof including housing 98 which contains a burner head similar to previously-described burner head 60 for the ignition of fuel supplied thereto from a fuel source such as LP tank 18. The housing 98 is substantially the same as housing 70 which is typically provided with the large, dome-shaped reflector hood 68, as previously discussed. In the heating apparatus 94 herein the large reflector hood 68 is eliminated, and at least one louver 100 is provided for reflecting heat emanating from burner assembly housing 96.

More particularly, the housing assembly 96 can include a cylindrical wall portion 102 disposed between conical top and bottom cap portions 104 and 106 with the wall portion 102 being perforated so as to provide an apertured cylindrical emitter surface 108 similar to previously-described apertured emitter surface 72. Hot air generated by combustion in the housing 98 exits through apertures 108*a* and is directed generally radially out therefrom due to the vertical cylindrical orientation of the surface 108. In this regard, the louver 100 is configured so as to direct heat exiting from the apertures 108*a* and infrared heat emanating from the housing wall 102 in a generally downward direction about the longitudinal axis 94*a* of the apparatus 94. The advantages of utilizing louver 100 over the prior reflector hoods is in its greatly reduced size and adjustability so that the area to be heated can be readily varied according to the needs of the user(s).

More particularly, the louver 100 includes a proximate portion 110, a main annular body portion 112, and a distal bent portion 114. The louver 100 is adjustably attached to the housing 98 at the proximate portion 110 such as by surface clamps or any other suitable fastening mechanism which allows the position of the louvers 100 relative to the central axis 94*a* to be readily adjusted and then fixed in place. As shown, proximate portion 110 can extend radially outward and downwardly with the annular body portion 110 also inclined radially outward and downward, however at less of an angle from the vertical axis 94*a* with the body portion 112 being significantly larger than the proximate portion 110 so as to extend radially outward for a greater distance than the proximate portion 110. At the radially outer end of the body portion 112, distal portion 114 is bent downward at a greater angle from the axis 94*a* than body portion 112 such as at an angle similar to proximate portion 110 and extends to distal end 114*a* of the louver 100.

As can be seen in FIG. 10B, it is preferred that multiple louvers 100 such as vertically spaced louvers 100*a,* 100*b* and 100*c* be adjustably attached about the housing 98 which allows the spacing, B, between the adjacent louvers 100*a*–100*c* to be varied. In addition, the greater number of louvers 100 also minimizes the risk of there being accidental contact with the hot cylindrical wall portion 102 of the housing 98.

As previously discussed, one particular advantage arising from the use of the louvers 100 is in their relatively small size. In particular, it is preferred that the maximum distance, R, from the central axis 94*a* to the distal end 114*a* of the louver 100 be less than the radius of the base 12, e.g. 10.3 inches when sized to fit the standard size LP tank 18. In this manner, the louvers 100 can be removed from the housing 98 and fit in the base 12 for storage and transportation.

In addition and as previously discussed, the adjustability of the louvers 100 allows the area thereunder that is being warmed to be varied according to the needs of the user(s). For example, where there are fewer people around the apparatus 94, a tighter radius about the axis 94*a* can be warmed which can readily be achieved by adjusting the louver(s) 100 downwardly reducing the effective radius, R, from the central axis 94*a,* as depicted in phantom in FIG. 10A. On the other hand, where there are a larger number of people that are gathered about the apparatus 94, the louvers 100 can be adjusted back toward their maximum radius R to increase the radial extent of the area about the apparatus axis 94*a* that is warmed by the heat emanating from the housing 98.

The adjustability of the louver 100 also provides for significant flexibility in determining the best spacing between adjacent louvers 100*a–c* as a function of the dimensions of the louvers, and in particular the body portion 112 and distal portion 114 thereof. In a preferred form as shown in FIG. 10B where three equally spaced louvers 100*a*–100*c* are employed, the radial length, A, of the annular portion 112 of the louvers 100 is approximately twice the spacing, B, between adjacent louvers 100*a*–100*c* and is approximately four times the radial length, C, of the distal bent portion 114 of the louvers 100. In addition, the body portion 112 is angled at approximately 120° from the vertical axis 94*a,* and the louvers 100*a–c* are formed so that an angle of approximately 150° is included between the annular body portion 112 and distal bent portion 114 thereof.

The use of louvers 100 provides heating efficiency and safety advantages over prior reflector hoods when used with a cylindrical burner assembly housing 98. As previously discussed, prior reflector hoods used with cylindrical emitter surfaces are deficient as not all of the heat emitted radially outward is reflected by the hood so that there is heat loss creating inefficiencies in heating the desired area about the heating apparatus and below the hood. These inefficiencies accordingly increases the amount of fuel necessary to heat the area to be warmed by the apparatus. On the other hand, as can be seen by reference to FIGS. 10A and 10B, the louvers 100 substantially minimize or eliminate any radiant heat emitted from cylindrical emitter surface 108 that does not encounter a louver 100 so that substantially all of the heat emanating from the housing 98 is reflected by the louvers 100 for heating of the desired area about the apparatus 94. In this manner, the louvers 100 provide for improved heating efficiency as less fuel needs to be consumed for heating of the preselected area about the apparatus 94 over the amounts of fuel necessary when a reflector hood is employed.

Figure 12:
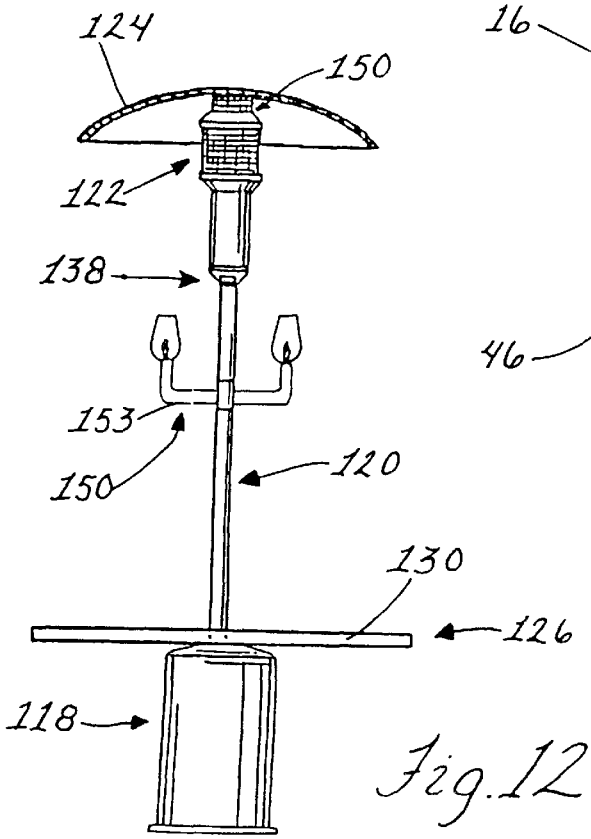
FIG. 12 is a view similar to FIG. 11 with the umbrella and the legs of the table removed and a gas light disposed between the reflector dome and the burner assembly housing.
Figure 13:
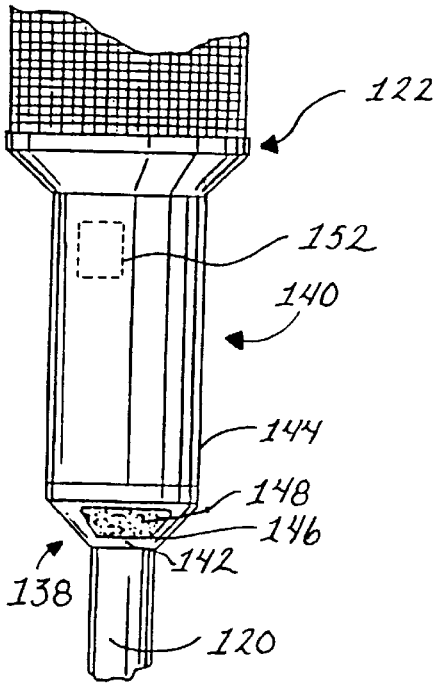
FIG. 13 is a enlarged fragmentary elevational view of the motion detector of the heating apparatus of FIGS. 11 and 12.
Figure 11:
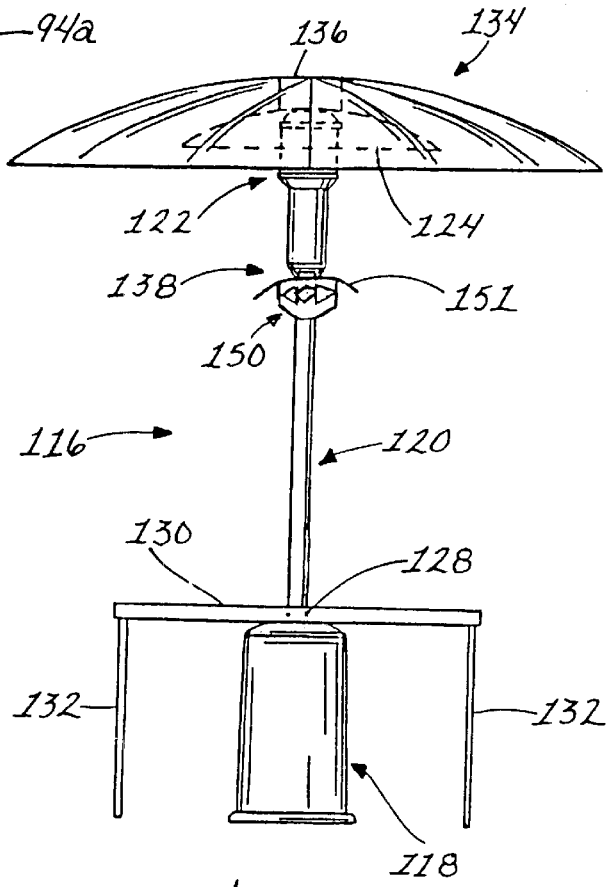
FIG. 11 is an elevational view of a heating apparatus with a table and legs, a motion detector for controlling ignition of the fuel when motion is detected, and an umbrella disposed over the reflector dome.

FIGS. 11–13 illustrate other improvements which can be incorporated into the previously-described heating apparatuses 10, 65 and 94. FIG. 11 shows a heating apparatus 116 having a base 118 for containing a fuel tank therein, and a standard 120 projecting upwardly therefrom to a burner assembly housing 122 with a reflector hood 124 attached to the housing 122 for reflecting heat downwardly, as previously described.

One improvement to heating apparatus 116 is the provision of a table 126 that has a central through opening 128 for receipt of the standard 120 therethrough. In this manner, the table top 130 is disposed above the base 118 with the standard 120 extending through the opening 128. Foldable legs 132 of the table 126 are pivoted out from under the table top 130 to provide the table 126 with stability when in use. The size of the legs 132 can be coordinated with that of the base 118 so that the table top 130 is closely adjacent or in engaugement with the top of the base 118. Alternatively the legs 132 can be omitted from the table 126 with the entire weight of the table top 130 resting upon the base 118, as shown in FIG. 12. To protect people sitting about the table 126 from precipitation or excessive exposure to sunlight during daylight hours, an umbrella 134 can be mounted on top of the apparatus via spacer block mount 136 attached on top of the reflector hood 134. As shown, the umbrella 134 can be fairly large so that it encompasses the reflector hood 124 and extends radially beyond the table top 130.

To enhance the functioning of the previously-described fuel efficiency systems 25, a motion sensor 138 can be provided for controlling the ignition of fuel by the burner assembly. The sensor 138 detects the motion of people about the apparatus so that if no one is present, there is no ignition of fuel by the burner assembly, and thus there is no fuel wasted for providing heating when none is needed. Similarly, when the motion sensor 138 detects the presence of people as by their movement, the sensor 138 will cause the ignition of fuel by the burner assembly to provide heating and warmth for the people about the apparatus.

As shown with respect to apparatus 116, the motion sensor 138 can be disposed in an enlarged lower valve housing extension 140 of the burner assembly housing 122 between it and the top of the standard 120. More particularly, the extension 140 has a bottom frustoconical section 142 attached to the top of the standard 120 with the frustoconical section 142 tapering from the main section 144 of the valve housing extension 140 down to the top of the pole 120, and being provided with a window 146 for sensor element 148, as best seen in FIG. 13. The motion sensor 138 and sensing element 148 thereof can comprise an infrared or sonar type of motion sensor which send out infrared light beams or sound waves, respectively, that when interrupted cause a change in the state of the sensor circuitry to indicate motion, as is known. Other devices for sensing motion and controlling ignition can also be utilized within the purview of the present invention.

As previously-discussed, the patio heaters described herein are oftentimes used by taverns and bars where no-smoking laws make patrons go outdoors to smoke. As such, these heaters are primarily for nighttime outdoor use. Accordingly, lighting about patio heaters is a significant concern. In this regard, a light such as gas light 150 can be provided in conjunction with heating apparatus 116, as can be seen in FIGS. 11 and 12. As shown, the gas light 150 can be mounted at various locations on the apparatus 116 such as between the housing 122 and the reflector 124, and preferably is fed with fuel from the same source that feeds fuel to the burner assembly for illuminating the area about the apparatus 116 that is warmed thereby. In this manner, patrons standing about the apparatus 116 have an area that is well-lit and at a comfortable temperature providing conditions similar to that found indoors.

Where the temperatures are too great for the gas light 150 to be mounted under the hood 124, the light 150 can instead be provided along the standard 120. Where the light 150 is mounted on the standard 120 as in FIG. 11, a reflector 151 can be disposed thereover so that the heat from the light 150 is substantially blocked from raising the temperature of the valve unit contained in the housing extension 140 thereabove. Alternatively, where the gas light 150 is as shown in FIG. 12 with arms 153 extending from the standard 120, the reflector 151 need not be provided.

Referring to FIG. 13, a tip switch 152 can be included such as in the form of a mercury switch that can sense when the apparatus 116 tips a predetermined amount. When this tipped condition is detected, the switch 152 interrupts the signal from the themocouple holding the gas valve open so as to shut the unit off. Thus, if the unit 116 tips over and falls, the heater will not stay on as the tip mercury switch 152 will cause the gas valve to close for shutting the unit 116 down.

Another advantageous feature that can be incorporated into the heating units 10, 65, 94 or 200 described herein is a Fresnel glass lens-type enclosure 154 (FIG. 3) for the burner assembly housing or emitter assembly with the lens enclosure 154 having Fresnel ridges 154*a* for radiating heat therefrom. In this manner, the problems with wind and pressure build-up in the burner assembly housing as described earlier with respect to apparatus 200 can be significantly minimized as the glass enclosure 154 serves to shield the housing or emitter assembly including the inclined emitter surface from wind without affecting the heating effect achieved by the unit.

While there have been illustrated and described particular embodiments of the present invention, it will be appreciated that numerous changes and modifications will occur to those skilled in the art, and it is intended in the appended claims to cover all those changes and modifications which fall within the true spirit and scope of the present invention.

I claim:

1. A heating apparatus for igniting fuel from a fuel tank having a control valve for controlling a supply of fuel from the tank, the heating apparatus comprising:

a heat emitter including a burner assembly for igniting fuel from the fuel tank to provide heat emanating from the emitter;

an elongate support member mounting the heat emitter at an upper end thereof and including a gas line extending therethrough for feeding fuel from the tank to the burner assembly for ignition; and a shroud for fitting over the fuel tank, being slidably engaged on said elongate support member for reciprocal vertical movement and including an access opening at a predetermined location on the shroud with the opening being sized to expose a portion of said fuel tank and allow an operator access to the fuel tank control valve for controlling supply of fuel to the burner assembly without sliding said shroud relative to said support.

2. The heating apparatus of claim 1 wherein the fuel tank is a standard LP cylinder and the shroud has a cylindrical configuration larger than the LP cylinder so that the shroud can slide thereover.

3. The heating apparatus of claim 1 wherein the shroud includes a cylindrical wall and the access opening is formed adjacent an upper end of the wall so that the opening is generally level with the fuel tank control.

4. The heating apparatus of claim 1 wherein the shroud includes a wall extending about the fuel tank, and a plurality of perforations in the shroud wall smaller in size than the access opening to permit airflow therethrough.

5. The heating apparatus of claim 1 wherein the shroud includes a cylindrical wall and an upper cover having a central opening into which the support member extends so that the shroud wall is centrally aligned relative to the support member.

6. The heating apparatus of claim 1 wherein the shroud includes a wall extending about the fuel tank, and a support flange onto which the fuel tank is placed, the support flange being of a diameter larger than the shroud wall for supporting the shroud thereon.

7. The heating apparatus of claim 1 including a hood member attached over the heat emitter and extending radially outward, the hood member including a lower surface that reflects heat downwardly for heating a predetermined area about the support member.

8. The heating apparatus of claim 1 in combination with the fuel tank, the fuel tank being a standard 20 lb. LP fuel tank with the controls therefor being at an upper end thereof.

9. The heating apparatus of claim 1 wherein said elongate support member is supported upon a base by a plurality of legs, said legs define a space for receiving the fuel tank, and said shroud is slidable over said legs and the tank, and engauges said base.

10. A heating apparatus for igniting fuel from a fuel tank having a control valve for controlling a supply of fuel from the tank, the heating apparatus comprising:

a heat emitter including a burner assembly for igniting fuel from the fuel tank to provide heat emanating from the emitter;

an elongate support member mounting the heat emitter at an upper end thereof and including a gas line extending therethrough for feeding fuel from the tank to the burner assembly for ignition;

said elongate support member is supported upon a base by a plurality of legs, said legs define a space for receiving the fuel tank; and a shroud for fitting over the fuel tank and including an access opening at a predetermined location on the shroud with the opening being sized to allow an operator access to the fuel tank control valve for controlling supply of fuel to the burner assembly, and said shroud configured for surrounding said legs and the tank, and engaging said base.

* * * * *